United States Patent [19]

Jones

[11] 4,027,614

[45] June 7, 1977

[54] SAILBOAT CONSTRUCTION

[76] Inventor: Clyde B. Jones, 3531 Alginet Drive, Encino, Calif. 91436

[22] Filed: Apr. 7, 1975

[21] Appl. No.: 565,348

[52] U.S. Cl. ..... 114/163; 114/61; 114/280

[51] Int. Cl.[2] ..... B63H 25/06

[58] Field of Search ..... 114/163, 61, 39, 162, 114/66.5 H

[56] References Cited

UNITED STATES PATENTS

| | | | |
|---|---|---|---|
| 2,858,788 | 11/1958 | Lyman | 114/39 |
| 3,147,730 | 9/1964 | Specht | 114/163 |
| 3,788,257 | 1/1974 | Miller | 114/61 |
| 3,796,175 | 3/1974 | Ford, Jr. et al. | 114/61 |

FOREIGN PATENTS OR APPLICATIONS

| | | | |
|---|---|---|---|
| 692,218 | 10/1930 | France | 114/162 |

*Primary Examiner*—Trygve M. Blix
*Assistant Examiner*—Stuart M. Goldstein
*Attorney, Agent, or Firm*—Jack C. Munro

[57] ABSTRACT

The present invention is comprised of a high speed sailboat partially or completely supported by canted retractable hydrofoils with or without an antiheel device. The antiheel device consists of controllable stabilizers mounted on rudders and provides inherent pitch direction stability and manual control of attitude and motion in the lateral, heel and pitch directions. The antiheel device is applicable to both displacement and dynamic supported sailboats.

8 Claims, 19 Drawing Figures

SAILBOAT CONSTRUCTION

BACKGROUND OF THE INVENTION

This invention pertains to the field of high performance sailboats supported by either flotation or by hydrodynamic forces or by a combination of both.

In general, a hydrofoil sailboat, when compared to a conventional catamaran, has superior performance in strong winds and inferior performance in light winds. While a hydrofoil sailboat can have superior performance when on a broad reach, it suffers from a performance inferior to conventional catamarans when sailing close to the wind. The larger catamarans have a marked superior performance over the smaller sizes but are not as easily trailered or handled and are considerably more expensive. Smaller hydrofoil sailboats are not so limited in high performance and offer the fascination of being able to take off and become foil borne. The potential of combining the best features of hydrofoil and multihull sailboats has not been fully realized.

A sailboat must develop an underwater resistance to the side force caused by sail wind pressure. This is usually accomplished by the leeway action of the boat which causes pressure differentials on the underwater surfaces of the hull. The drag on the boat exerted by the underwater pressures is dependent largely upon the aspect ratio of the underwater surfaces. The aspect ratio is measured by the average draft divided by the water line length of the boat. The aspect ratio is improved by the addition of such as centerboards, dagger boards or keels. However, these surfaces, as customarily used, fall short of fully minimizing the underwater drag due to side forces.

A sailboat's thrust is derived from wind forces acting collectively at a point approximately at the geometric center of the sails. This sail force is divided into two components: the heeling force which acts in a beamwise direction toward the lee side of the boat and the pitching force which acts in a forward direction parallel to the length of the boat. The heeling moment is a couple consisting of the heeling force and an equal and opposite force exerted against the boat's underwater surfaces in a beamwise direction. The pitching moment is a couple consisting of the pitching force and an equal and opposite force resisting the forward motion of the boat in the water. Obviously, the pitching force is instrumental in producing forward motion and the heeling force produces leeway. The pitching moment tends to force the bow down and, in extreme cases, can cause pitch poling which is a capsize with the boat stern rotating up over the bow. The heeling force tends to cause the boat to lean in a beamwise direction where the sails are considerably less efficient and, in extreme cases, roll the boat over to where it capsizes. In high speed sailboats, a capsize is usually a combination of heeling and pitching. The speed of a sailboat is obviously greatly effected by the pitching and heeling force and moment.

A sailboat's maximum speed on any tack is limited by a number of factors one of which is the maximum permissible sail force that can be sustained without capsizing by heeling, by pitch poling or by a combination of both. Stability of conventional sailing craft is achieved by advantageous separation of the center of gravity of the boat and the center of buoyancy (or center of support by hydrodynamic forces). Conventional attempts to improve heeling stability have lead to such devices as outriggers and trapezes to support the crew while suspended over the windward side to increase the separation between the center of buoyancy and center of gravity. The use of hydrodynamic forces to counter heeling tendency has not been fully exploited.

High speed catamarans suffer from a tendency toward bow down attitude bordering on pitch poling even with the crew as far aft as possible. When a sailboat is in a bow down attitude, mild wave action can induce pitch poling. Also, the hull lines created by the bow down attitude offer inferior hydrodynamic characteristics. The use of hydrodynamic forces to produce antipitching moments has not been fully realized.

SUMMARY OF THE INVENTION

The present invention is comprised of several sailboat configurations involving various combinations of an antiheel device and hydrofoil arrangements. Also included is a configuration easily convertible to most of the other configurations and a simplified configuration using conventional rudders instead of the antiheel device.

The basic hydrofoil, used in constructing the various configurations, is one which extends downward and away from the hull at an angle with the vertical of approximately 45° plus or minus 15°. The hydrofoil is cantilevered out from the hull and is supported by structure internal to the hull in such a fashion as to be slidably or rotatably retractable.

The antiheel device consists of rudders equipped with hydrofoils and located beamwise from each other. An interconnecting mechanism between the rudder and hydrofoil assemblies provides control of the hydrofoils' angle of attack differentially or unidirectionally to produce antiheel and antipitch moments opposing the sail force moments.

Each one of the configurations offers either improved performance or improved controllability or both for the sailing conditions for which it was intended. The convertible configuration offers improved performance and controllability under all sailing conditions.

It is an object of this invention to provide a sailboat with improved performance, controllability and versatility.

It is another object of this invention to provide an improvement in performance of conventional catamarans at a minimum expense.

DESCRIPTION OF THE SHOWN EMBODIMENTS

Figure 2:
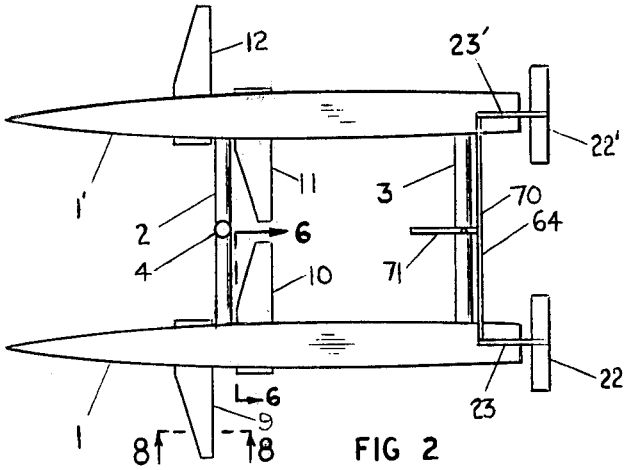
FIG. 2 is a plan view of FIG. 1, with sails not shown, shows all hydrofoils extended and stabilizing surfaces.
Figure 1:
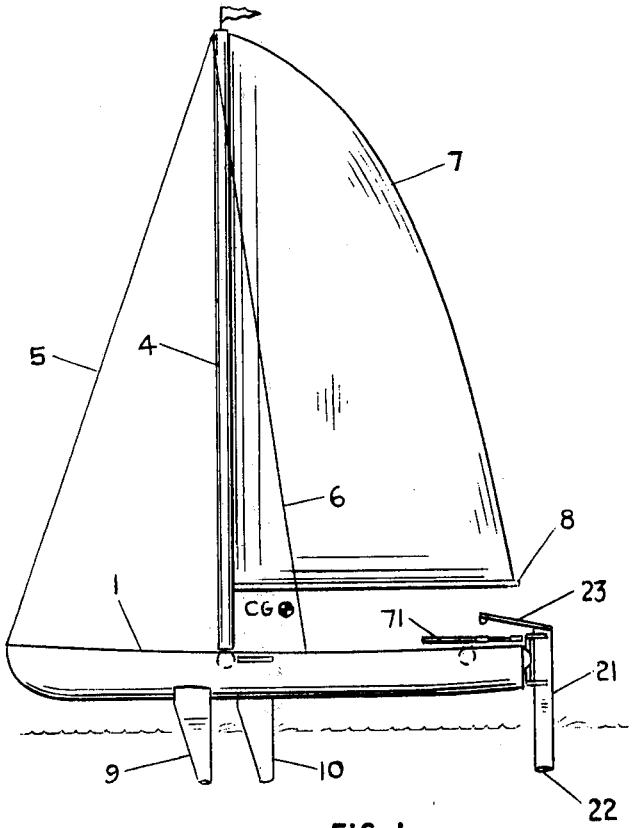
FIG. 1 is a side elevation of a sailboat embodying the present invention.

Referring to the drawings, FIG. 1 and 2 illustrate a sailboat of configuration similar to a catamaran having two hulls 1 and 1′ structurally connected by two tubular aluminum cross beams 2 and 3. The mast 4 is mounted on the center of cross beam 2 and supported by stay 5 and windward and leeward shrouds 6 and 6′ which are structurally attached to the hulls. Sail 7 is supported by the mast 4 and boom 8.

Figure 8:
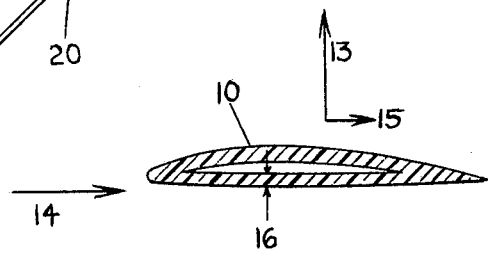
FIG. 8 is a cross sectional view, designated on FIG. 2 as 8—8, of a hydrofoil showing the typical shape and construction.

The hydrofoils 9, 10, 11 and 12 are wing-like surfaces tapering from a constant cross section to smaller dimensions at the outer end. The hydrofoil cross section, FIG. 8, is one of the many available standard foil shapes as developed in wind and water tunnel testing to be capable of producing a substantial transverse force 13 when subjected to a water flow 14 at a relative low drag force 15 parallel to flow 14. The hydrofoils 9, 10, 11 and 12 are fabricated of many fiberglass cloth layers bonded with resin to form a structural shell 16 of substantial thickness.

Inboard hydrofoils 10 and 11 are located lengthwise between the mast and the center of gravity. The outboard hydrofoils 9 and 12 are located lengthwise just forward of cross beam 2 so as not to interfere with the structural attachment of cross beam 2. Hydrofoils 9 and 10 are mounted on hull 1 and hydrofoils 11 and 12 are mounted on hull 1′.

Figure 6:
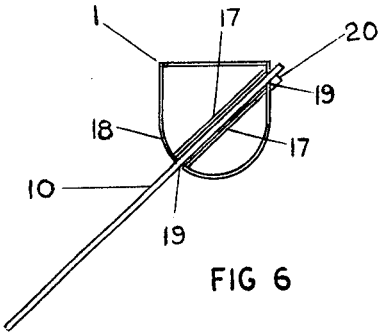
FIG. 6 is a cross sectional view, designated on FIG. 2 and 6—6, of a typical hydrofoil installation in the extended position.
Figure 7:
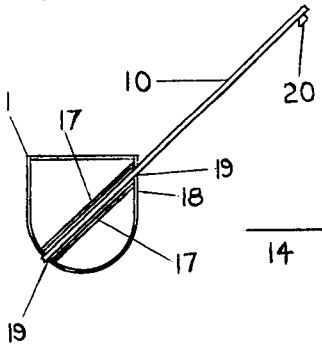
FIG. 7 is the same cross sectional view as FIG. 6 but with the hydrofoil in the stored position.

At each hydrofoil 9, 10, 11 and 12 position a housing 17, FIG. 6, is provided for structural support of the hydrofoil 9, 10, 11 and 12. The housing 17 is canted in the hull structure as shown in FIG. 6 which is typical of all hydrofoil 9, 10, 11 and 12 installations. The housing 17 is shaped to fit around the portion of the hydrofoil 9, 10, 11 and 12 which is of constant cross section and provides slidable means for extending the hydrofoils 9, 10, 11 and 12 to a position as shown in FIG. 6 or for slidably retracting hydrofoils 9, 10, 11 and 12 to a stored position as shown in FIG. 7.

Figure 3:
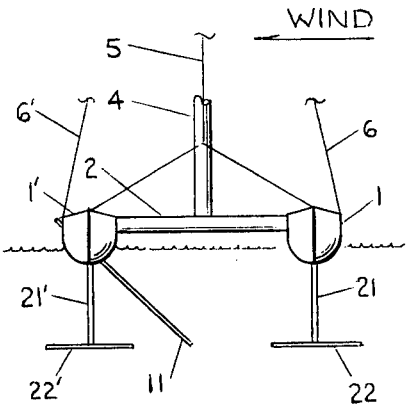
FIG. 3 is a front elevation of the sailboat showing the configuration with one hydrofoil in operating position.
Figure 4:
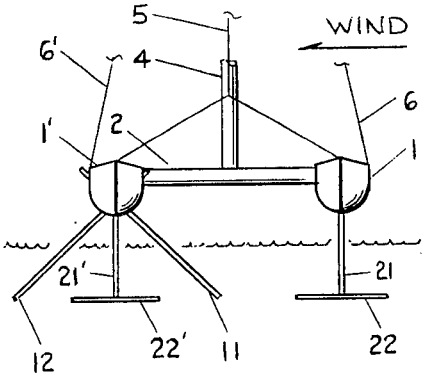
FIG. 4 is a front elevation of the sailboat showing the configuration with the two leeward hydrofoils in operating position.
Figure 5:
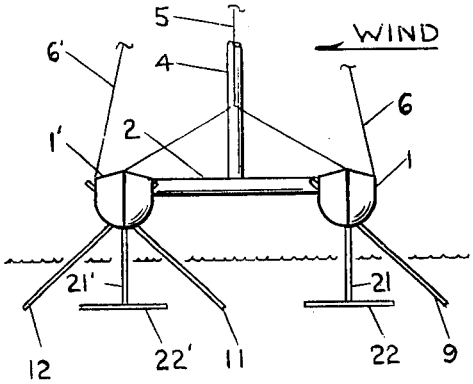
FIG. 5 is a front elevation of the sail showing the configuration with the two leeward hydrofoils and one windward hydrofoil in operating position.

The housing 17 extends on a slope between the inside surfaces of each hull 1 and 1′ where the housing 17 is structurally bonded to the hull skin 18. Cutouts 19 in the hull skin 18 fit closely to the contour of the constant cross section of the hydrofoil 9, 10, 11 and 12 and define its position and angle. The hydrofoils 9, 10, 11 and 12 make a fixed angle with the vertical in the approximate range of from 30° to 60°. The housing 17 is made of fiberglass cloth layers bonded with resin and when installed forms a water tight barrier. Hydrofoils 9, 10, 11 and 12 are prevented from further extension in the extended position by lug 20 which is integral with the fiberglass shell structure 16 of each hydrofoil 9, 10, 11 and 12. The hydrofoils 9, 10, 11 and 12 can be completely withdrawn and stored if desired. The hydrofoils 9, 10, 11 and 12 can be extended in various combinations, three of which are illustrated by FIGS. 3, 4 and 5. The importance of these variations will become apparent in the explanation of operation to follow.

Figure 18:
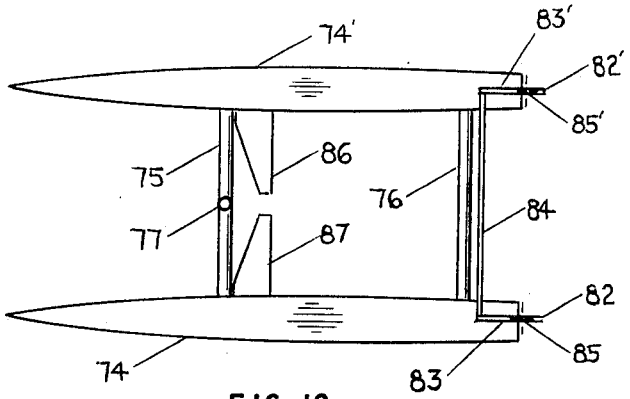
FIG. 18 is a plan view of FIG. 17 with sails not shown.
Figure 17:
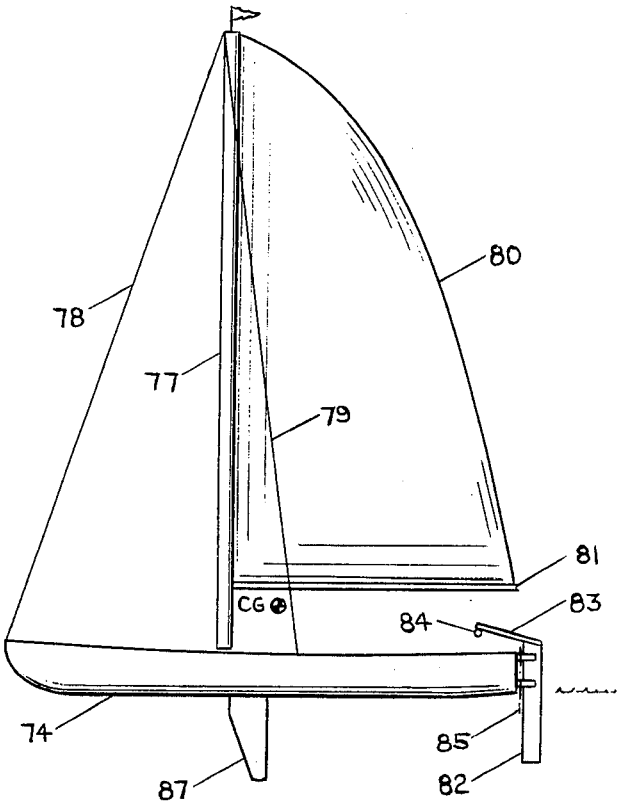
FIG. 17 is a side elevation of a configuration similar to FIG. 3 but without stabilizers.

FIGS. 17 and 18 illustrate a sailboat of conventional catamaran configuration having two hulls 74 and 74′ structurally connected by two tubular aluminum cross beams 75 and 76. The mast 77 is mounted on the center of cross beam 75 and supported by stay 78 and shrouds 79 and 79′ which are structurally attached to the hulls. Sail 80 is supported by the mast 77 and boom 81. Conventional rudders 82 and 82′ and tillers 83 and 83′ are rotatably supported by the hulls 74 and 74′ to swing about vertical center lines 85 and 85′. Tube 84 rotatably interconnects the forward ends of tillers 83 and 83′.

Figure 19:
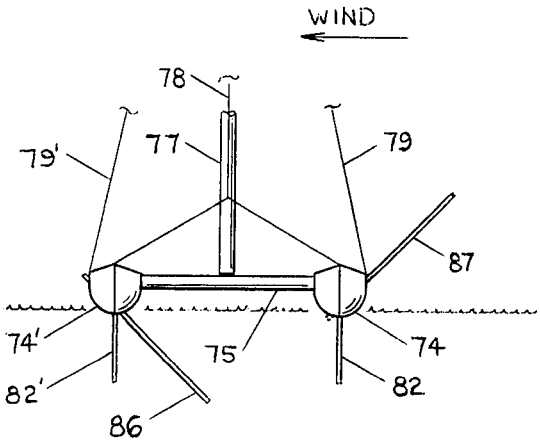
FIG. 19 is a front elevation of FIG. 17.

Hydrofoils 86 and 87 similar to 10 and 11 as shown in FIGS. 1 and 2, are mounted the same as shown in FIG. 6 for hydrofoil 10 in each hull 74 and 74′ at a position aft of the mast and forward of the boat center of gravity. The hydrofoils are slidably mounted so that the leeward hydrofoil 86 may be extended while the windward hydrofoil 87 is retracted as shown in FIG. 19. The hydrofoils 86 and 87 are mounted so that when extended and subjected to water flow they will produce a substantial transverse force 13, FIG. 8, perpendicular to the flow 14 in a direction as to oppose the sail heeling force and the weight of the boat.

Figure 9:
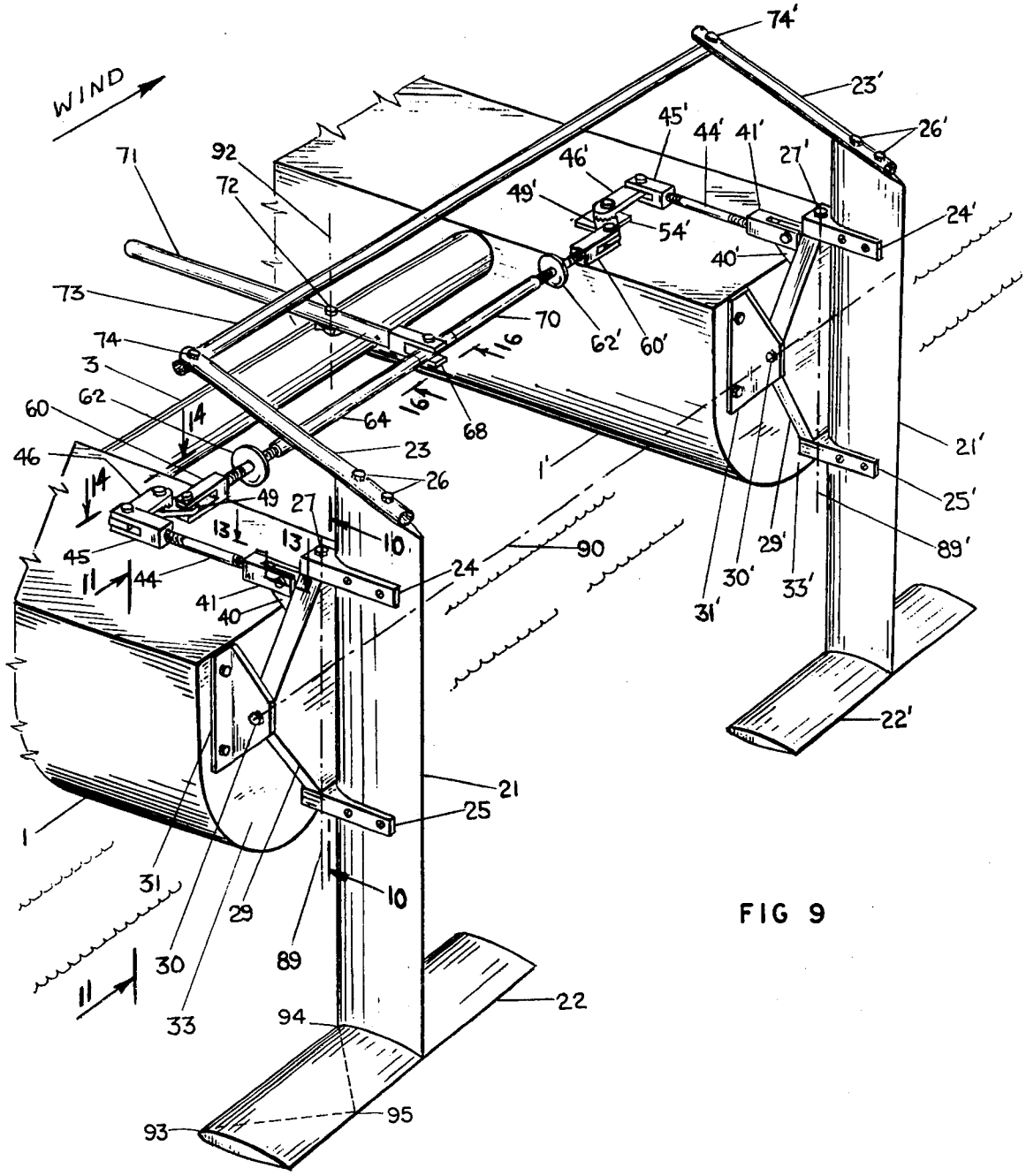
FIG. 9 is a perspective view looking from a position to the left and behind the boat and showing the rudders, stabilizers and their control system.
Figure 11:
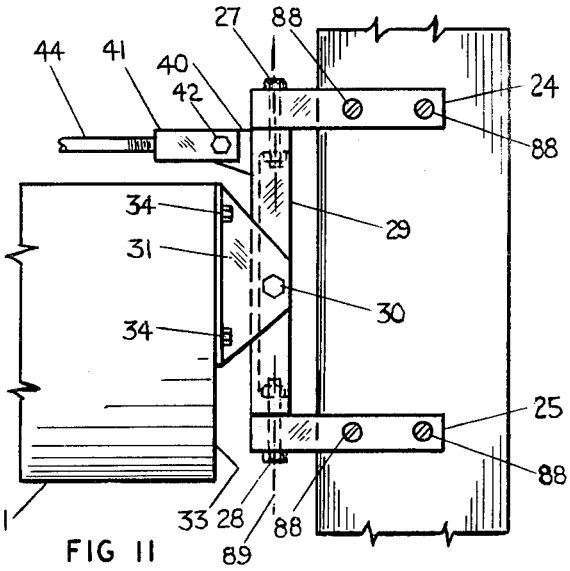
FIG. 11 is a side elevation, designated on FIG. 9 as 11—11, of the rudder and stabilizer gimbal arrangement.
Figure 10:
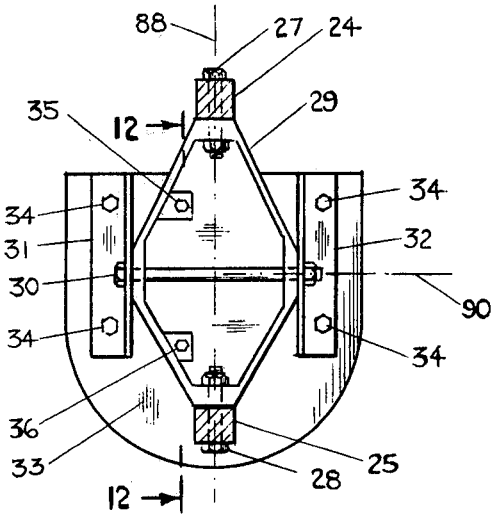
FIG. 10 is a cross sectional view, designated on FIG. 9 by 10—10, of the gimbal mechanism for rudder and stabilizer rotation.

As shown in FIG. 9, the rudder and stabilizer assemblies and mechanism are mounted on the aft section of hulls 1 and 1′. The rudder 21, the stabilizer 22, the tiller 23 and the hinge brackets 24 and 25 make up into an assembly. Hinge brackets 24 and 25 are attached to the rudder 21 with machine screws 88. The tiller 23 is attached to the top of the rudder 21 with bolts 26. The aluminum stabilizer 22 and aluminum rudder 21 are welded together at the bottom of the rudder 21 where the rudder is contoured to fit the center of the stabilizer 22. The rudder 21 and stabilizer 22 assembly is mounted to rotate about the vertical center line 89 of bolts 27 and 28 which pass thru brackets 24 and 25 and gimbal 29 as shown in FIG. 10 and 11. Gimbal 29 is mounted to rotate about center line 90 of bolt 30 which passes thru gimbal 29 and brackets 31 and 32. Brackets 31 and 32 are rigidly mounted on hull transom 33 by bolts 34. Stabilizer 22 has a symmetrical foil section as shown in FIG. 9 which will produce, when the boat is in forward motion, substantially vertical forces either up or down depending on the direction of displacement of rudder 21 and stabilizer 22 assembly about horizontal center line 90. The chord plane of stabilizer 22 is defined by the three points 93, 94, and 95 as shown in FIG. 9 of the drawings. Points 93 and 94 are located on the leading edge of stabilizer 22 and point 95 is located on the trailing edge of stabilizer 22. Stabilizer 22′ has a similarly defined chord plane. The rudder 21 also has a symmetrical foil section which produces substantially beamwise forces when the boat is in motion and the rudder 21 assembly is displaced around vertical center line 89.

Figure 12:
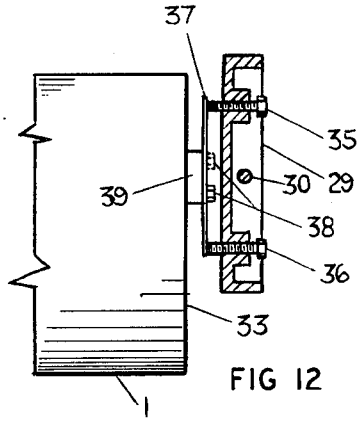
FIG. 12 is a cross sectional view, designated on FIG. 10 as 12—12, of the centering spring device for the gimbal.

Bolts 35 and 36 are threaded thru bosses in gimbal 29 as shown in FIG. 12. The bolts 35 and 36 are adjusted by turning to extend them forceably against flat spring 37 which is retained by bolts 38 which clamp spring 37 and spacer 39 rigidly to transom 33. Spring 37, bolts 35 and 36 and spacer 39 are required on one hull only.

Figure 13:
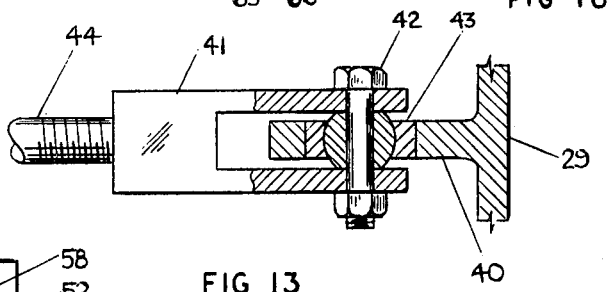
FIG. 13 is a partial sectional view, designated on FIG. 9 as 13—13, of the clevis attachment to the gimbal.

Flange 40 is integrally and structurally a part of gimbal 29 as shown in FIGS. 11 and 13. Clevis 41 is rotatably mounted by bolt 42 to ball joint assembly 43 pressed into flange 40, as shown in FIG. 13, allowing freedom of motion of clevis 41 in any rotational direction to avoid binding from misalignment caused by crank operation. Clevis 41 is threaded onto connecting rod 44 whose opposite end is threaded into clevis 45 as shown in FIGS. 9, 14 and 15.

Figure 14:
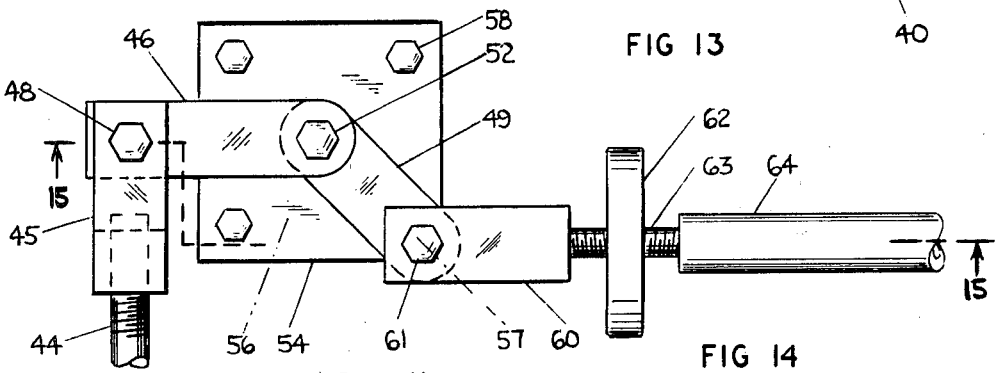
FIG. 14 is a plan view, designated on FIG. 9 as 14—14, of the crank and linkage arrangement for control of the gimbal.
Figure 15:
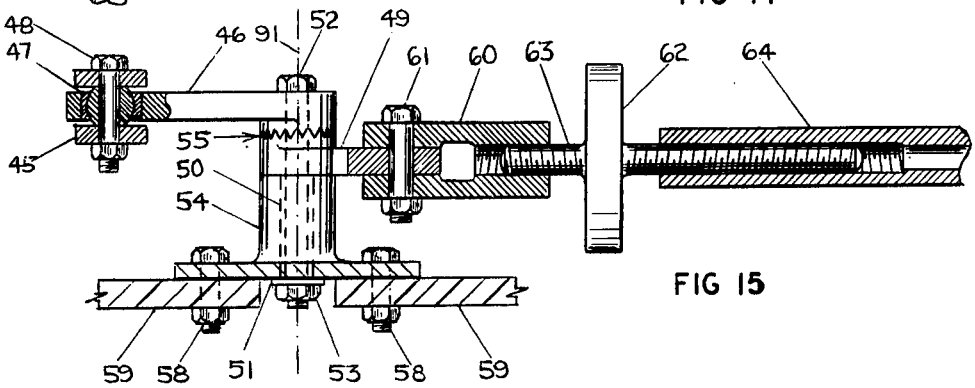
FIG. 15 is a partial sectional view, designated on FIG. 14 as 15—15, of detail of the crank and linkage arrangement of FIG. 14.

Clevis 45 is rotatably mounted on crank 46 on another ball joint assembly 47 pressed into crank 46 and fastened by bolt 48 as shown in FIGS. 14 and 15. Cranks 46 and 49, spacer bushing 50 and washer 51 are rigidly clamped together by bolt 52 and nut 53 with bracket 54 installed between crank 49 and washer 51 and encompassing spacer bushing 50. Clearances are provided such that bushing 50 is free to rotate in the bore of bracket 54 and all parts clamped to bushing 50 rotate about the vertical center line 91 of bolt 52.

Crank 46 and crank 49 are equipped with radial serrations 55 in adjoining faces such that the two cranks 46 and 49 are held by the serrations 55 in rotational relationship to each other when clamped by bolt 52. By loosening bolt 52, the angle between cranks 46 and 49 can be adjusted to engage the serrations 55 at a new position and at a limit in the adjustment to at least the positions indicated by dotted lines 56 and 57 in FIG. 14. Bracket 54 is rigidly mounted to deck structure 59 by bolts 58.

Crank 49 is rotatably attached to clevis 60 by bolt 61. A wheel 62 integral with a transversely disposed shaft 63 is threaded into clevis 60 and connecting tube 64. Threads on shaft 63 extending into clevis 60 are of opposite lead or hand to those threads extending into connecting tube 64 such that turning wheel 62 will lengthen or shorten distance between ends of clevis 60 and connecting tube 64.

Figure 16:
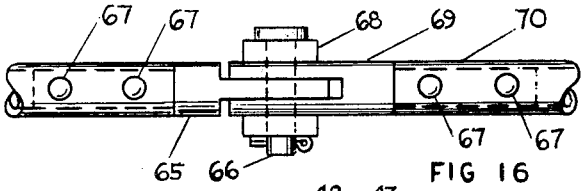
FIG. 16 is an elevation, designated on FIG. 9 as 16—16, of the connection of the control arm to the connecting tubes.

Connecting tube 64 extends to approximately the center line of the boat where it is fastened by rivets 67 to tube end 65, FIG. 16. Tube end 65 is rotatably retained by pin 66 in tube clevis 69 and clevis 68 as shown in FIG. 16. Tube clevis 69 is fastened by rivets 67′ to connecting tube 70 which in turn is connected to an apparatus on the lee hull 1′. Said apparatus is symmetrical about the center line of the boat to that apparatus just described and mounted on hull 1.

Clevis 68 is welded to control arm tube 71, FIG. 9, which is mounted on cross beam 3 so as to rotate about bolt 72 vertical center line 92. Control arm 71 extends forward of bolt 72 forming a tiller-like arrangement which may be operated by foot or hand.

Connecting tube 73 is rotatably joined by bolts 74 and 74′ to the forward ends of tillers 23 and 23′ to form an interconnection between rudders. Control arm 71 and connecting tube 73, in conjunction with trim wheel 62, are the operating controls necessary to define attitude of the boat in any direction.

With windward crank 49 and leeward crank 49′ (FIG. 9) adjusted to approximately position 56 (FIG. 14) and for a given motion of control arm 71 to leeward, the forward motion of windward connecting rod 44 is greater than the aft motion of leeward connecting rod 44′. This action causes a larger displacement of windward stabilizer 22 than leeward stabilizer 22′ and in the opposite direction. With cranks 49 and 49′ at position 57, the reverse occurs and windward stabilizer 22 has less displacement than the leeward stabilizer 22′. When windward cranks 46 and 49 and leeward cranks 46′ and 49′ are adjusted perpendicular to each other, then displacement of control arm 71 causes equal displacement of stabilizers 22 and 22′. Position 56 is approximately in the range for operation in a hydrofoil configuration. When the system of FIG. 9 is used in conjunction with planing type hulls, the range of adjustment near position 57 may be necessary to counter characteristic bow up tendencies of some planing boats at certain speeds.

Clevises, connecting rod and tube ends, brackets, wheel, gimbal, rudder and stabilizer are machined out of aluminum bar stock. Tubing, angle brackets and rods are machined as necessary from stock tubing and extrusions of aluminum. All fasteners are stock aluminum items. All aluminum parts are anodized for corrosion protection. Flat spring 37 is machined from stainless steel.

In operation with the boat in forward motion and the wind tending to heel the boat to leeward and pitch the bow down, the operator displaces the control arm 71 to leeward which motion is transmitted thru the various linkages and swings the windward stabilizer 22 aft around center line 90 and the leeward stabilizer 22′ forward around center line 90. This decreases the angle of attack on the windward stabilizer 22 and increases the angle of attack on the leeward stabilizer 22′ causing an up load on the leeward stabilizer 22′ and a down load on the windward stabilizer 22. The geometry of the linkage with crank 49 and 49′ adjusted to approximately position 56 (FIG. 14) causes the down load and displacement of windward stabilizer 22 to be higher than the up load and displacement of leeward stabilizer 22′. The loads on the two stabilizers 22 and 22′ are then equivalent to a couple countering the sail force heeling moment and a down load which in conjunction with an equivalent additional up load at the main hydrofoils (11 and 12 for example) creates a couple opposing sail force bow down pitching moment.

The stabilizers 22 and 22′ and hydrofoils (11 and 12 for example) provide automatic stability while resisting boat pitch motion and maintaining boat height above the water. At a given velocity, the vertical load carrying capability of the sloping hydrofoils 11 and 12 varies with the depth of water penetration and the angle of attack. By this means the hydrofoils 11 and 12 determine the height of operation above the water. The stabilizers 22 and 22′ tend to track behind the hydrofoils 11 and 12 defining boat pitch attitude and hydrofoils' 11 and 12 angle of attack. Disturbances of pitch attitude by outside sources such as waves or wind gusts cause stabilizer moments about the boat center of gravity substanially in excess of the opposing moments from the change in angle of attack of the hydrofoils. This fact qualifies the boat for pitching stability by the classic methods of making this determination. Similar stability and control is attained when stabilizers 22 and 22' are used in conjunction with hulls in flotation as in FIG. 3.

The pitch attitude at which the boat is maintained by the stabilizers 22 and 22' is determined by the angle that the stabilizers 22 and 22' make with the boat around center line 90. Hand wheel 62 or 62' turned in either direction causes a change in the distance between pivotal points on end fittings 60 and 60'. This causes stabilizers 22 and 22' to pivot in the same direction, the direction depending upon which way that hand wheel 62 or 62' was moved. In their new positions, stabilizers 22 and 22' cause the stern to track behind the main hydrofoils in a stable attitude at an angle higher or lower than prior to adjustment. This device is used to accommodate changes in boat loading and center of gravity and to maintain low angles of attack on the main foils to prevent cavitation and ventilation.

There are attitudes and conditions in which the system shown in FIG. 9, used for heel attitude control, is not self centering. The device shown in FIG. 12 provides a self centering spring force which is a dock side adjustment requiring no attention in operation. Rotation of bolts 35 and 36 in the same direction increases or decreases the spring 37 centering load on control arm 71 and overpowers noncentering feed back loads from stabilizers 22 and 22'. Opposite rotation of bolts 35 and 36 determines the no load centering position of control arm 71.

The main hydrofoils (11 and 12 for example) counteract side loads caused by sail forces. The necessary side load resistance is generated automatically by leeway action of the foils. Leeway increases load on the inboard hydrofoil 11 and decreases load on outboard hydrofoil 12 resulting in a side force opposing sail forces. The rudders 21 and 21' supply lateral direction forces to balance the boat and maintain the necessary leeway and lateral stability.

The natural pitch stability of the boat makes it possible for the operator to control the boat with the conventional tiller and the one foot controlled arm 71. The natural reaction when the boat heels is to lean to windward bracing one's foot against some part of the boat. This same tendency to push with the foot when the boat heels makes it easy for the crew in transition from a conventional catamaran to the foot operated antiheel system. The secondary antipitch action from operation of arm 71 is a bonus. Because of the considerable latitude of pitch attitude, wheel 62 or 62' needs attention only when wind or boat loading change.

Tiller 23 can be used to control heel instead of foot operated control arm 71. However, the loads required on tiller 23 are considerably higher than those required on control arm 71. Tiller 23 position presents an awkward angle for the operator to apply and sustain a load for any length of time.

Beamwise displacement of the interconnect tube 73 causes the rudders 21 and 21' to rotate equally about center lines 89 and 89' in the normal fashion of catamaran rudders without effecting the stabilizers' 22 and 22' vertical load control.

In operation, the configuration of FIG. 3, with only the inboard lee hull hydrofoil 11 extended, is preferred for tacking close to the wind and light wind sailing. In this condition, the hydrofoil 11 acts mostly as a centerboard or keel to resist the side force exerted by wind pressure on the sail.

When in configuration of FIG. 3, the hydrodynamic force exerted on the hydrofoil 11 perpendicular to its surface creates a horizontal component and a vertical component. The horizontal component opposes with equal magnitude the beamwise force on the sail. The vertical component, in combination with flotation, exerts sufficient force to support the weight of the boat. At low speeds the hydrodynamic forces are low and the boat is majorly supported by flotation. At high speeds and higher sail force, the hydrofoil force increases to where a major portion of the boat weight is supported by the vertical component causing the boat to raise in the water reducing flotation loads and wetted area of the hull. The shifting of sailboat weight from support by hull flotation to the more efficient hydrofoil support substantially reduces drag and increases speed. If hydrofoil 11 is at the proper angle, its force vector will pass thru the intersection of the wind vector concentrated at the center of effort of the sails and a vertical thru the effective center of gravity which is the point where the combination of antiheel moment and weight of the boat may be considered acting. The antiheel moment is created by differentially operated stabilizers 22 and 22' and effectively moves the center of gravity of the boat to windward by a distance equal to the moment divided by the weight of the boat. With all the force vectors intersecting at a point, then the boat is balanced in heel and majorly supported by dynamic forces acting on the one hydrofoil 11. If the wind is of sufficient velocity, a skilled crew can maintain balance on one hydrofoil with both hulls out of the water.

When operating by using configuration of FIG. 4 with both hydrofoils 11 and 12 extended on the lee hull and with sufficient wind, the boat can be "flown" on hydrofoils 11 and 12 with the hulls 1 and 1' out of the water. Here the vector resultant of the forces on hydrofoils 11 and 12 must pass thru the intersection of the wind sail force vector and the vertical thru the effective center of gravity in order for heeling stability to exist. In the low speed stage, both hulls are in the water but as wind force and speed increase the hydrodynamic forces on hydrofoils 11 and 12 become sufficient to sustain the boat weight and the windward hull can be sustained in a position suspended above the water by use of the heel control arm 71. This is considered the highest speed configuration.

Configuration of FIG. 5 is the same as FIG. 4 except that the windward hydrofoil 9 is extended to provide automatic heel stabilization. More wind sail force is required to heel the boat when hydrofoil 9 clears the water than when it is submerged as shown in level position of FIG. 5 and this creates a natural tendency for the boat to resist heeling. This makes it easier for the crew to maintain the boat in level position but the thrust available for propulsion is not as high as for configuration of FIG. 4. This configuration is considered best for pleasure sailing in good winds and for novice crews.

When in the configuration of FIG. 19, the mode of operation is the same as described for configuration of FIG. 3 except that the antiheel device of FIG. 9 has been replaced by conventional rudder system shown in FIG. 17 and 18. The crew must rely entirely on the shifting of their own weight to maintain heel stability and pitch stability. The hydrofoil 86 serves to support part of the weight of the boat as well as operate to resist beamwise sail force, as in configuration of FIG. 3, and as a result there is less drag and better performance. This configuration, although not as good a performer as the others, is more economical to build and is an improvement in performance over a conventional catamaran.

Configurations of FIGS. 3, 4, 5 and 17 are based on the wind approaching the boat from the port side. When coming about to put the wind on the starboard side, it is necessary for the crew to retract the inboard starboard hydrofoil 11 and extend the inboard port hydrofoil 10.

Heel control system FIG. 9 operates in the same manner on either tack.

While the preferred embodiment shows a twin hull catamaran configuration, it is clear that the basic principle of the improvement applies also to single hull, outriggers, trimarans and other configurations. This is obvious upon inspection of FIG. 4 where the windward hull is not serving as a dynamic or flotation support and is functioning merely as part of the boat structure. This indicates the basic need for only one hull to support the hydrofoils and to supply flotation means when not supported by hydrofoils. Additional hull or outriggers serve to improve stability, to supply means for housing additional foil units and to supply means for providing maximum beamwise spread of the antiheel stabilizers, but do not change the fundamental principle of the improvement.

While FIG. 9 illustrates a preferred embodiment, it is obvious that there are many alternate configurations possible to accomplish the fundamental objective of enabling the sailboat operator to create an antiheel moment by control of the angle of attack of stabilizers. For instance, the stabilizers 22 and 22′ may be rotatably mounted on the rudders or each stabilizer may include a wing flap-like structure with a hinge line in or near the fixed stabilizer. These modifications merely constitute equivalent mechanical means for moving the stabilizer chord plane's axis of rotation to a different position than shown in the preferred embodiment. In this case, similar mechanism to that shown can be used for actuation by connecting the shown mechanism to the stabilizer or flaps thru a flexible push pull wire housed in a flexible tube.

I claim:

1. In combination with a sailboat having at least one sail, at least one mast, a vertical reference line passing through the center of gravity of said sailboat when in level position, a hull assembly, said hull assembly comprising at least one hull; antiheel structure comprising:

rudder means comprising a first rudder and a second rudder spaced apart from each other, said first and said second rudders being hingedly connected to said hull assembly with each hinge axis oriented in the general direction of said vertical reference line;

stabilizer means comprising a first stabilizer and a second stabilizer, each said stabilizer being airfoil-like in shape and having a leading edge and a trailing edge, each said stabilizer having a chord plane, said chord plane being defined by three points, two of said points being located on any portion of said leading edge and the third of said points being located on any portion of said trailing edge of said stabilizer, said first stabilizer being supported by said first rudder such that said first stabilizer's chord plane is oriented in a generally perpendicular position relative to said sailboat vertical reference line, said second stabilizer being supported by said second rudder such that said second stabilizer's chord plane is oriented in a generally perpendicular position relative to said sailboat vertical reference line, each said stabilizer being adapted to move under the surface of a body of water upon which said sailboat is located;

pivot means connecting said stabilizer means to said hull assembly, whereby said stabilizer's chord planes are capable of assuming various selected angles with respect to the said sailboat vertical reference line;

first actuating means connected to said rudder means for moving both said first and said second rudders and their respective said stabilizers;

second actuating means for pivotly moving simultaneously each said stabilizer about the axis of said pivot means, said first stabilizer's chord plane pivots opposite to said second stabilizer's chord plane; and said second actuating means includes a linkage assembly, an actuating member assembly capable of being manually controlled being connected to said linkage assembly, upon movement of said actuating member assembly in a single direction said linkage assembly includes means for causing said first stabilizer's chord plane to pivot opposite to said second stabilizer's chord plane.

2. The combination as defined in claim 1 wherein:

said hull assembly includes hydrofoil means connected to said hull assembly, said hydrofoil means comprising surfaces in contact with the water which contribute lifting forces acting upon said sailboat when in forward motion.

3. In combination with a sailboat having at least one sail, at least one mast, a vertical reference line passing through the center of gravity of said sailboat when in level position, a hull assembly, said hull assembly comprising at least one hull; antiheel structure comprising:

rudder means comprising a first rudder and a second rudder spaced apart from each other, said first and said second rudders being hingedly connected to said hull assembly with each hinge axis oriented in the general direction of said vertical reference line;

stabilizer means comprising a first stabilizer and a second stabilizer, each said stabilizer being airfoil-like in shape and having a leading edge and a trailing edge, each said stabilizer having a chord plane, said chord plane being defined by three points, two of said points being located on any portion of said leading edge and the third of said points being located on any portion of said trailing edge of said stabilizer, said first stabilizer being supported by said first rudder such that said first stabilizer's chord plane is oriented in a generally perpendicular position relative to said sailboat vertical reference line, said second stabilizer being supported by said second rudder such that said second stabilizer's chord plane is oriented in a generally perpendicular position relative to said sailboat vertical reference line, each said stabilizer being adapted to move under the surface of a body of water upon which said sailboat is located;

pivot means connecting said stabilizer means to said hull assembly, whereby said stabilizers' chord planes are capable of assuming various selected angles with respect to the said sailboat vertical reference line;

first actuating means connected to said rudder means for moving both said first and said second rudders and their respective said stabilizers;

second actuating means for pivotly moving simultaneously each said stabilizer about the axis of said pivot means, said first stabilizer chord plane pivots opposite to said second stabilizer's chord plane; and said second actuating means includes a linkage assembly, a single actuating member capable of being manually controlled being connected to said linkage assembly, upon movement of said single actuating member in a single direction said linkage assembly includes means for causing said first stabilizer's chord plane to pivot opposite to said second stabilizer's chord plane.

4. The combination as defined in claim 3 wherein:

said linkage assembly including first adjustment means, said first adjustment means for varying the initial selected angle between said stabilizers' chord planes and said sailboat vertical reference line for each said stabilizer.

5. The combination as defined in claim 4 wherein:

said linkage assembly including second adjustment means for varying the pre-established ratio of the pivot motion of said first stabilizer's chord plane relative to the pivot motion of said second stabilizer's chord plane.

6. In combination with a sailboat having at least one sail, at least one mast, a vertical reference line passing through the center of gravity of said sailboat when in level position, a hull assembly, said hull assembly comprising at least one hull; antiheel structure comprising:

rudder means comprising a first rudder and a second rudder spaced apart from each other, said first and said second rudders being hingedly connected to said hull assembly with each hinge axis oriented in the gneral direction of said vertical reference line;

stabilizer means comprising a first stabilizer and a second stabilizer, each said stabilizer being airfoil-like in shape and having a leading edge and a trailing edge, each said stabilizer having a chord plane, said chord plane being defined by three points, two of said points being located on any portion of said leading edge and the third of said points being located on any portion of said trailing edge of said stabilizer, said first stabilizer being supported by said first rudder such that said first stabilizer's chord plane is oriented in a generally perpendicular position relative to said sailboat vertical reference line, said second stabilizer being supported by said second rudder such that said second stabilizer's chord plane is oriented in a generally perpendicular position relative to said sailboat vertical reference line, each said stabilizer being adapted to move under the surface of a body of water upon which said sailboat is located;

pivot means connecting said stabilizer means to said hull assembly, whereby said stabilizers' chord planes are capable of assuming various selected angles with respect to the said sailboat vertical reference line;

first actuating means connected to said rudder means for moving both said first and said second rudders and their respective said stabilizers;

second actuating means for pivotly moving simultaneously each said stabilizer about the axis of said pivot means, said first stabilizer's chord plane pivots opposite to said second stabilizer's chord plane;

said hull assembly includes hydrofoil means connected to said hull assembly, said hydrofoil means comprising surfaces in contact with the water which contribute lifting forces acting upon said sailboat when in forward motion; and said second actuating means includes a linkage assembly, a single actuating member capable of being manually controlled being connected to said linkage assembly, upon movement of said single actuating member in a single direction said linkage assembly includes means for causing said first stabilizer's chord plane to pivot opposite to said second stabilizer's chord plane.

7. The combination as defined in claim 6 wherein:

said linkage assembly including first adjustment means, said first adjustment means for varying the initial selected angle between said stabilizer's chord planes and said sailboat vertical reference line for each said stabilizer.

8. The combination as defined in claim 7 wherein:

said linkage assembly including second adjustment means, said second adjustment means for varying the pre-established ratio of the pivot motion of said first stabilizer's chord plane relative to the pivot motion of the said second stabilizer's chord plane.

* * * * *